US005402595A

United States Patent [19]

Tamllos

[11] Patent Number: 5,402,595

[45] Date of Patent: Apr. 4, 1995

[54] SHOOTING DEVICE

[76] Inventor: George M. Tamllos, 310 N. Main, P.O. Box 6, Vernon, Utah 84080

[21] Appl. No.: 165,420

[22] Filed: Dec. 13, 1993

[51] Int. Cl.[6] ..... F41C 27/00

[52] U.S. Cl. ..... 42/94

[58] Field of Search ..... 42/94

[56] References Cited

U.S. PATENT DOCUMENTS

| | | | |
|---|---|---|---|
| 3,007,581 | 11/1961 | Moore | 42/94 |
| 3,225,656 | 12/1965 | Flaherty et al. | 42/94 |
| 3,313,505 | 4/1967 | Petrie | 42/94 |
| 4,393,614 | 7/1983 | Pickett | 42/94 |
| 4,676,021 | 6/1987 | Groba | 42/94 |
| 4,876,814 | 10/1989 | Lombardo | 42/94 |
| 5,194,678 | 3/1993 | Kramer | 42/94 |
| 5,274,940 | 1/1994 | Guzy | 42/94 |
| 5,317,826 | 6/1994 | Underwood | 42/94 |

*Primary Examiner*—David Brown

[57] ABSTRACT

A new and improved shooting device comprising a hollow cylindrical vertical support member for supporting the rifle from underneath. A two-piece rotatable cap and ball tilt mechanism enables adjustment of declination and inclination of the rifle supported in a gun rest operably coupled at the top end of the vertical support member. A U-shaped gun rest for supporting a rifle is operably coupled at the top end of a two-piece rotatable and ball tilt mechanism.

11 Claims, 3 Drawing Sheets

SHOOTING DEVICE

BACKGROUND OF THE INVENTION

FIELD OF THE INVENTION

The present invention relates to shooting device and more particularly pertains to shooting device which may be used in rocky, mountainous, and other environs having uneven surfaces by rifle sportsmen during hunting or target shooting endeavors.

DESCRIPTION OF THE PRIOR ART

Rifle sportsmen have long sought to become more accurate in their target shooting and hunting endeavors. The average shooter is subject to small involuntary muscle tremors when shooting. These tremors often causes the gun barrel to stray from its target. To minimize this effect, shooters have steadied their aim over the years using a variety of natural and manmade items, ranging from trees and boulders to various supports, bipods, rests and other devices. Trees and boulders make adequate supports but are not often conveniently placed relative to the target or quarry, and have traditionally been very difficult to transport. Manmade supports, bipods, rests and other devices of that mien have typically been inconvenient to transport and use, particularly over, and on, uneven terrain. Terrain such as that encountered in mountainous regions presents special challenges to both equipment and sportsmen.

Most bipods and supports are of a fixed length and fixedly hold the barrel or forearm of the gun. Many such supports are also integral with the firearm. Consequently, these models are most effective when used on level surfaces. Rocky and sloped terrain make it extremely difficult for users to set the feet of most rigid supports in a firm and level position for shooting purposes. If, for example, a fixed support can be successfully positioned and used in training a rifle sight on game on a sloped surface, erratic or extreme movement of the game may move cause the quarry to move out of range, necessitating the lifting and relocation of the support to regain the target. Thus, temporarily at least, defeating the purpose of that support.

An ideal support would be compact and easy to transport, would allow for the widest possible range of use, would enable the user to set it up quickly and easily on virtually any type of terrain, and would be easily reconfigured and used as a monopod, bipod, tripod, or quadrapod, using one, two, three, or four legs, respectively. An independently movable cap and ball mechanism, quick adjust height feature, and adjustable legs would combine to enable the user to compensate for uneven terrain and keep the rifle level. Such a support would also be forgiving in the sense of allowing the sportsman to reorient his rifle quickly and regain a bead on the target without having to first withdraw the device from the ground and select a new location due to normal movement of the prey. The present invention addresses these requirements.

The use of shooting bipods is known in the prior art. More specifically, shooting bipods heretofore devised and utilized for the purpose of hunting and target shooting are known to consist basically of familiar, expected and obvious structural configurations, notwithstanding the myriad of designs encompassed by the crowded prior art which have been developed for the fulfillment of countless objectives and requirements.

The present invention is directed to improving devices for shooting bipods in a manner which is safe, secure, economical and aesthetically pleasing.

For example, U.S. Pat. No. 5,029,407 to Kirkpatrick discloses a collapsible bipod for a pistol.

U.S. Pat. No. 3,445,082 to Proctor, et al describes a small arms bipod having two legs.

Another patent of interest is U.S. Pat. No. 4,351,224 to Curtis disclosing a bipod mechanism for a light machine gun comprising a pair of telescoping legs.

U.S. Pat. No. 4,625,620 to Harris, describes a bipod for a firearm attachable to the sling swivel stud and having a pair of adjustable telescoping legs.

U.S. Pat. No. 5,050,330 to Pilgrim et al, describes a gun rest of resilient plastic with vertical notches for supporting a gun forearm.

Finally, U.S. Pat. No. 4,397,112 to York describes a rifle bipod comprising a pair of legs which grasp a gun barrel and provide support.

The bipod mechanisms mentioned above, while sufficient for their intended usages, do not specifically address the requirements for a shooting bipod used on rocky or mountainous terrain by a rifle sportsman shooting at game or a target.

The present invention is best suited for use on rocky or mountainous terrain by a rifle sportsman shooting at game or targets.

The present invention unlike the others above, provides easy transport, may be used on rocky or mountainous terrain, is quickly and easily adjustable, provides for a range of heights, may be used with from one to four support members, and is self storing. The independently movable cap and ball mechanism, quick adjust height feature, and adjustable legs also combine to enable the user to compensate for uneven terrain and keep the rifle level.

In this respect, the shooting device according to the present invention substantially departs from the conventional concepts and designs of the prior art, and in so doing provides an apparatus primarily developed for the purpose of shooting bipods which may be used in rocky, mountainous, and other environs having uneven surfaces by rifle sportsmen during hunting or target shooting endeavors.

Therefore, it can be appreciated that there exists a continuing need for new and improved shooting device which can be effectively used on rocky or mountainous terrain, is quickly and easily adjustable, provides for a range of heights, may be used with one, two, or three support members, and is self storing. In this regard, the present invention substantially fulfills this need.

As illustrated by the background art, efforts are continuously being made in an attempt to refine shooting bipods. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of shooting bipods now present in the prior art, the present invention provides an improved shooting device construction wherein the same can be utilized for firing from rocky or mountainous terrain. As such, the general purpose of the present invention, which will be described subsequently in greater detail, is to provide a new and improved shooting device apparatus which has many of the advantages of the shooting bipods mentioned heretofore and many novel features that result in a shooting device which is not anticipated, rendered obvious, suggested, or even implied by any of the prior art shooting bipods, either alone or in any combination thereof and which has none of the disadvantages of the prior art shooting bipods.

The invention is defined by the appended claims with the specific embodiment shown in the attached drawings. For the purpose of summarizing the invention, the invention may be incorporated into a new and improved shooting device comprising a hollow cylindrical vertical support member. The vertical support member has a top end, a bottom end, and a wall surface integral with, and extending between the top and bottom ends for supporting a rifle from underneath. A U-shaped gun rest for supporting a rifle is operably coupled to a two-piece rotatable and ball tilt mechanism. The two-piece rotatable and ball tilt mechanism enables adjustment of declination and inclination of a rifle supported in the gun rest and is operably coupled to the top end of the vertical support member. A quick adjust mechanism is provided comprising a rotatable knob nut for adjustment of the height of the vertical support member. A leg base having a top surface, a bottom surface, a front surface and a rear surface is detachably coupled to the bottom end of the vertical support member. The leg base has threaded apertures positioned about the bottom for enabling attachment of a multiplicity of leg members. At least one adjustable leg member having a top end and a bottom end, a side surface wall integral with, and extending between, the top and bottom ends, and a threaded portion at the top end, threadedly engages and extends from the leg base. The bottom end of the leg member is placed on the ground, thus enabling a method of stabilizing the bipod. The leg member is fitted with a non-slip foot at the bottom end.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Therefore, it is an object of the present invention to provide a new and improved shooting bipod comprising a hollow cylindrical vertical support member means having a top end, a bottom end, and a wall surface integral with and extending between the top and bottom ends for supporting a rifle from underneath; a U-shaped gun rest means for supporting a rifle operably coupled to a two-piece rotatable and ball tilt mechanism; a two-piece rotatable and ball tilt mechanism means for enabling adjustment of declination and inclination of a rifle supported in the gun rest operably coupled to the top end of the vertical support member means; a quick adjust mechanism comprising a rotatable knob nut for adjustment of the height of the vertical support member means; a leg base member means having a top surface, a bottom surface, a front surface and a rear surface detachably coupled to the bottom end of the vertical support member means with threaded apertures for enabling attachment of a leg member means; at least one adjustable leg means threadedly engaging and extending from the leg base member means for placing on the ground, thus enabling a method of stabilizing the bipod, the leg having a top end and a bottom end, a side surface wall integral with, and extending between, the top and bottom ends, a threaded portion at the top end, and a nonslip foot at the bottom end.

It is therefore an additional object of the present invention to provide a new and improved shooting bipod which has all the advantages of the prior art shooting bipods and none of the disadvantages.

An even further object of the present invention is to provide a new and improved shooting device which is susceptible of a low cost of manufacture with regard to both materials and labor, and which accordingly is then susceptible of low prices of sale to the consuming public, thereby making such shooting bipods economically available to the buying public.

Still yet another object of the present invention is to provide a new and improved shooting device which provides in the apparatuses and methods of the prior art some of the advantages thereof, while simultaneously overcoming some of the disadvantages normally associated therewith.

Still another object of the present invention is to provide a new and improved shooting device that may be used on rocky, mountainous, or uneven terrain.

Yet another object of the present invention is to provide a new and improved shooting device that may be easily and conveniently carried over either shoulder of the user while said user is also carrying a rifle slung over the back with no interference from the bipod and its rucksack.

Even still another object of the present invention is to provide a new and improved shooting device that may be used as a monopod, bipod, tripod or quadrapod.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
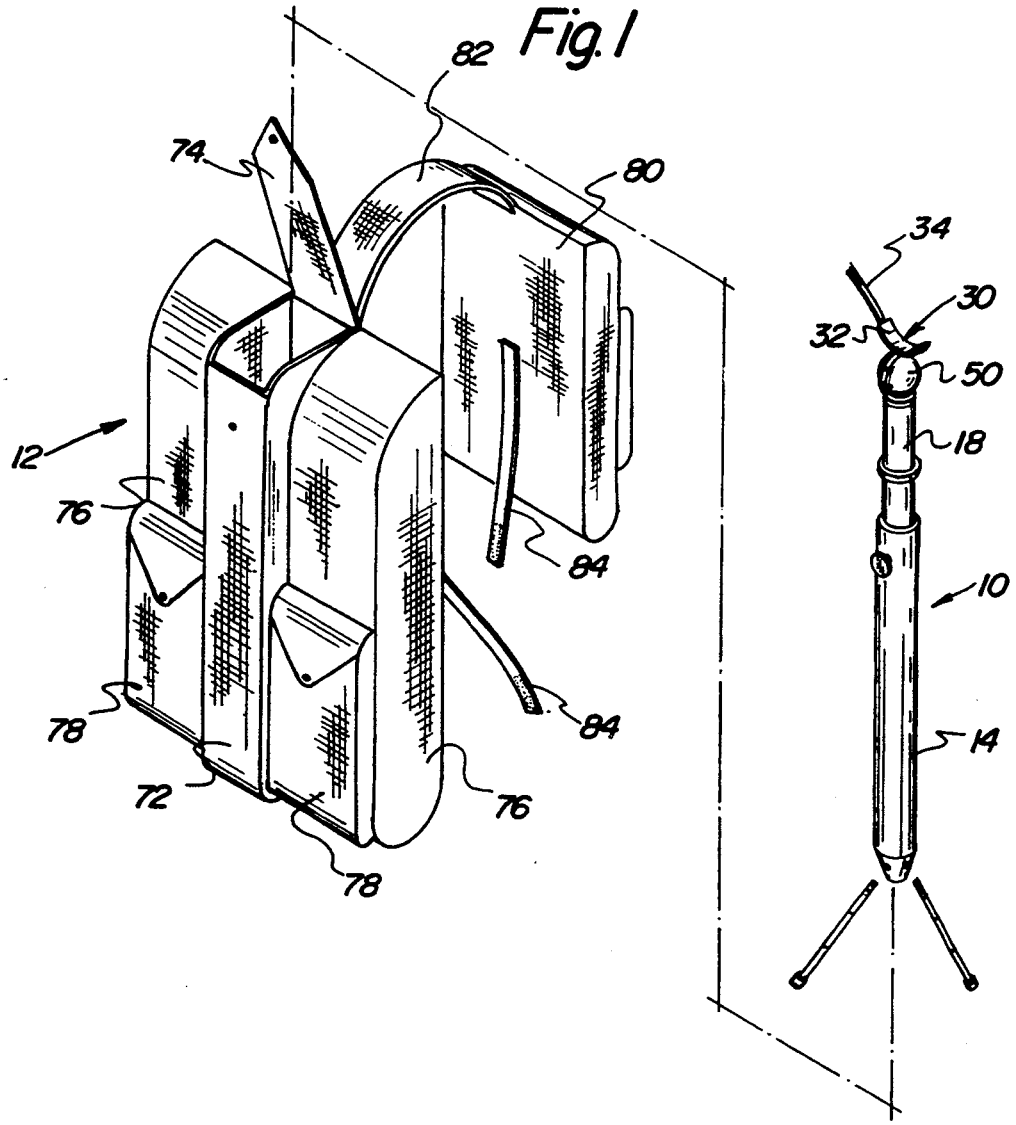
FIG. 1 is a perspective view of the present invention.
Figure 2:
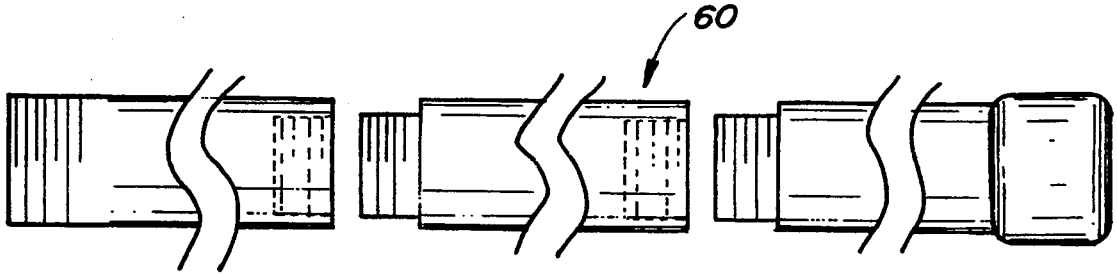
FIG. 2 is a partial elevation view showing legs and manner of assembly of the present invention.

With reference now to the drawings, and in particular to FIG. 1 thereof, a new and improved shooting device embodying the principles and concepts of the present invention and generally designated by the reference numeral 10 will be described.

From an overview standpoint, the shooting device is adapted for use with a rucksack 12. See FIG. 1.

More specifically, the new and improved shooting device comprises a hollow cylindrical vertical support member 14. This member has a top end, a bottom end, and a wall surface integral with and extending between the top and bottom ends for supporting a rifle (not shown) from underneath. The vertical support member may be produced in a variety of colors and in camouflaged patterns, with various finishes to suit the demands of local conditions.

A U-shaped gun rest means 30 for supporting a rifle is operably coupled to the top end of the vertical support member. The U-shaped gun rest comprises a preform shape 32 comprising supporting material for flexibly and snugly encompassing a rifle forearm portion. A flexible strap 34 is operably coupled to the rest for additionally securing a rifle portion in the gun rest and facilitating adjustments to the overall height of the shooting bipod by enabling the user to lift the rifle upwards to gain additional vertical extension of the bipod. Further, hook and fasteners are co-operably positioned on a free end of the strap and to an end of the preform shape, opposite the end of the shape coupled to the strap, for releasably securing the free end of the strap and preform shape for securing the bipod and rifle.

Figure 3:
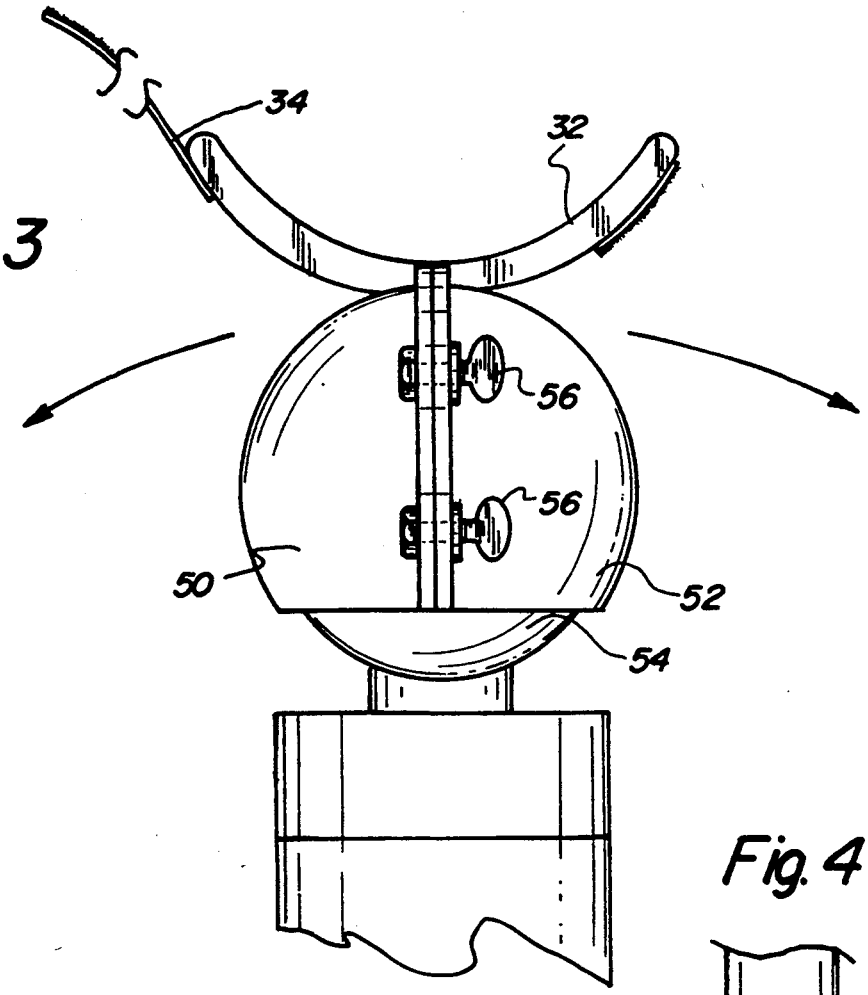
FIG. 3 is a partial perspective view showing two-piece rotatable and ball tilt mechanism and U-shaped gun rest of the present invention.
Figure 4:
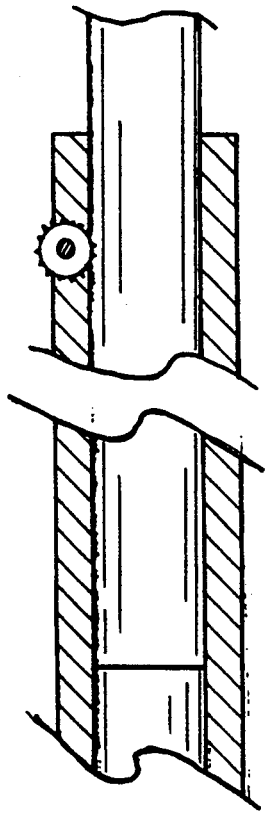
FIG. 4 is a cross-sectional view taken vertically through the adjustment mechanism at lines 4—4 of FIG. 3.

A rotatable two-piece cap 50 and 52 and ball 54 tilt mechanism enables adjustment of declination and inclination of a rifle supported in the gun rest. The cap and ball tilt mechanism are operably coupled at the top end of the vertical support member. Adjustment bolts positioned 56 through flanges along the periphery of each cap piece may be loosened by turning counterclockwise, or tightened by turning clockwise, thus enabling a range of adjustment of inclination and declination with a constraint varying from degrees of a dampening of action over the full range of motion to temporary locking at user-selected set positions, ranging from level with the apparent horizon to 20–30 degrees above or below the apparent horizon to compensate for uneven or sloped terrain. See FIGS. 3 and 4.

Housed within the vertical support member 14 are a first and second cylinder body sections 16 and 18. The cylinder bodies have a top end, a bottom end, and a wall surface integral with and extending between the top and bottom ends. See FIG. 5. The first cylinder body section has a lesser exterior diameter than the interior diameter of the vertical support member, the second cylinder body section has a lesser exterior diameter than the interior diameter of the first cylinder body, enabling a telescoping extension of cylinder body sections during use and a nesting capability within the vertical support member for compactness during storage. The vertical support member and the cylinder sections may be produced in a variety of colors and in camouflaged patterns, with various finishes to suit the demands of local conditions.

Operably coupled to the top end of the first cylinder body section is a rotatable knurled threaded ring 20 for securing and rendering immovable the second section relative the first. Clockwise rotation of the ring secures the first and second cylinder sections at the desired height, by way of clamping action from compression of the upper end of the first cylinder body section having a pair of opposing downwardly extending slots 22 therein. Counterclockwise rotation of the ring loosens the fit of the first and second sections, thus enabling a user to make adjustments of the overall height of the device.

A rotatable knob and threaded shaft 24 is positioned within an aperture 26 extending through the wall of the vertical support member for securing the first section 16 at a desired height within the vertical support. Clockwise rotation of the knob and threaded shaft allows extension the shaft for contacting the 1st cylinder section for fixedly securing the first cylinder section within the vertical support member. Counterclockwise rotation of the knob and threaded shaft unsecures the first section relative to the vertical support member, thus enabling a user to make additional adjustments of the overall height of the device.

In an alternate embodiment, the shooting device comprises a quick adjust mechanism. The quick adjustment comprises a knob and gear assembly and a series of detents for engaging teeth of the knob and gear assembly. Turning the knob turns a shaft coupled thereto. A gear having teeth along the periphery thereof contacts the detents. The gear turns against the detents in the wall surface of the second cylinder body section. Rotating the knob clockwise or counterclockwise raises and lowers the second cylinder body section, respectively. This enables precise, rapid additional adjustments of bipod height, constituting a quick adjust function.

Figure 5:
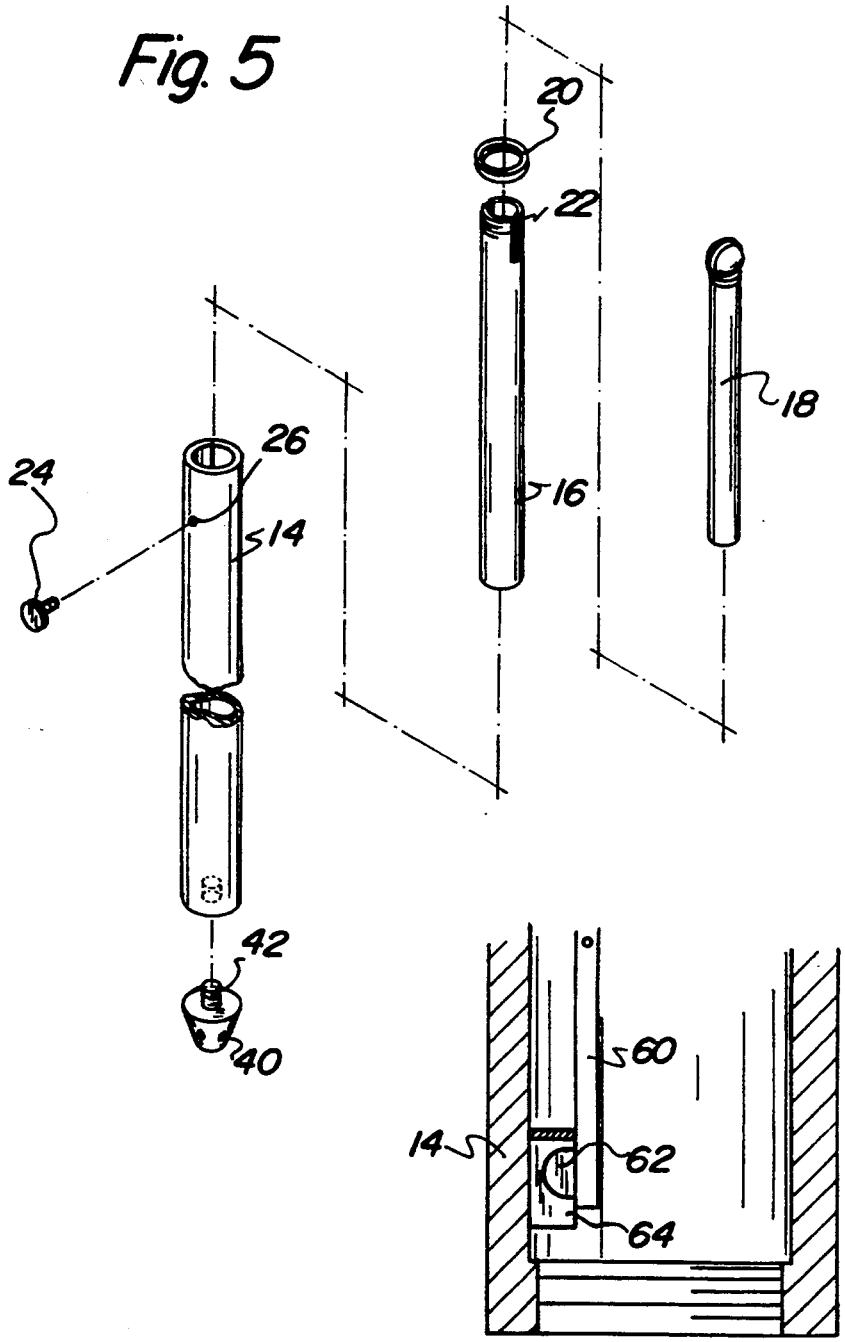
FIG. 5 is a partial exploded perspective view of a vertical support member, a first and second cylinder sections, a leg base, a knob nut, and a rotatable knurled threaded ring of the present invention.
Figure 6:
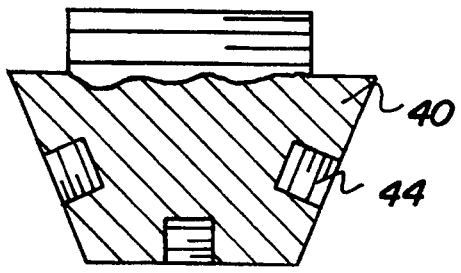
FIG. 6 is a partial sectional view of the leg base and threaded apertures plan view of the present invention.

As shown in FIGS. 5 and 6, a conical truncated leg base member 40 is detachably coupled to the bottom end of the vertical support member. This member has a larger diameter top end, a smaller diameter bottom end, and a wall surface integral with, and extending between. The leg base member also has an integral narrowed threaded portion 42 at the top end for threadedly engaging the vertical support member means. A multiplicity of threaded apertures 44 extend from the exterior wall surface inwardly for enabling attachment of leg members 60.

Each adjustable leg member is formed of a plurality of rods having a threaded portion extending from a first end and a threaded recess integral with a second end for coupling a number of rods to form legs of varying length. The bottom leg portion has a non-slip cap for positioning on the ground. At least one adjustable leg threadedly engages and extends from the leg base and is placed on the ground, thus enabling a method of stabilizing the bipod. The leg members comprise multiple threadedly engaging cylindrical sections 60 which may be assembled in various configurations for engagement with the leg base, yielding adjustments in overall shooting bipod height and positioning to suit requirements of the local terrain. The shooting bipod may be used with up to four legs as a quadropod, or with one, two, or three legs, as a monopod, bipod, or tripod, respectively.

The independently movable cap and ball mechanism, quick adjust height feature, and adjustable legs combine to enable the user to compensate for uneven terrain and keep the rifle level by adjustment of the aforementioned components individually and in combination.

The legs 60 are stored by being inverted and inserted upwardly through the bottom surface of the leg base and inwardly into the vertical support member for storage. Each leg has at least one ear tab 62 positioned thereon for mating with a bracket 64 within the vertical support member. Additional apertures in the bottom of the leg base member receive these ear tabs and secure the legs during storage.

As seen in FIG. 1, the present invention includes a fabric rucksack, 12. The rucksack is provided for conveyance and storage of the shooting bipod in a first portion. The first portion includes at least one storage channel 72 positioned centrally. The channels have a top and bottom end, extending from the top surface of the rucksack to the bottom surface. The storage channel is closed on the bottom and has an upwardly opening flap 74 positioned about the top end for receiving the shooting bipod for conveyance and storage and shielding the same from dirt and the elements. Similar additional storage channels 76 on either side of the central storage channel are provided for carrying supplies and miscellaneous accouterments. Supplemental pocket means 78 for carrying articles are positioned at a bottom portion of each additional storage channel on the external face thereof.

The rucksack also includes a second pack portion 80 opposite the first portion. The first and second portions are connected by a first strap 82 at the top ends thereof, and a second straps 84 at the bottom end of each portion. The second straps each having a free end for coupling to each other via hook and loop fasteners. The first and second straps are to be fastened one above and one below either shoulder of the user. The rucksack may be slung securely over one shoulder during conveyance due to the position of the straps. This arrangement, unlike that occasioned by typical backpacks, does not interfere with the conveyance of a rifle slung in customary fashion over the back of the user.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by LETTERS PATENT of the United States is as follows:

1. A new and improved shooting device comprising a hollow cylindrical vertical support member having a top end, a bottom end, and a wall surface integral with and extending between the top and bottom ends for supporting a rifle from underneath;

a two-piece rotatable cap and ball tilt mechanism means for enabling adjustment of declination and inclination of a rifle supported in a gun rest operable coupled at the top end of the vertical support member;

a U-shaped gun rest means for supporting a rifle operably coupled at the top end of a two-piece rotatable and ball tilt mechanism means;

a conical truncated leg base member having a larger diameter top end, a smaller diameter bottom end, and a wall surface integral with, and extending between, the to and bottom ends, having a narrowed threaded portion at the top end for threadably engaging the vertical support member and threaded apertures extending from the exterior wall surface inwardly;

at least one adjustable leg means threadedly engaging and extending from the leg base member for placing on the ground, thus enabling a method of stabilizing the the leg means comprising a plurality of rods having a threaded portion extending from first end and a threaded recess integral with a second end for coupling a number of rods to form legs of varying length, the bottom leg portion having a non-slip cap for positioning on the ground, allowing the present invention to be used with up to four legs as a quadruped, or with one, two, or three legs, as a monopod, bipod, or tripod, respectively.

2. The new and improved shooting device of claim 1 wherein the two-piece rotatable cap and ball tilt mechanism means further comprises adjustment bolts which may be loosened by turning counterclockwise, or tightened by turning clockwise, thus enabling a range of adjustment or inclination or declination with a constraint varying over the full range of motion to temporary locking at user-selected set positions, ranging from level with the apparent horizon from between about 20 and 30 degrees or below the apparent horizon to compensate for uneven or sloped terrain.

3. The new and improved shooting device of claim 1 wherein the U-shaped gun rest comprises a preform shape and material capable of encompassing a rifle forearm portion.

4. The new and improved shooting device of claim 3 wherein the U-shaped gun rest further comprises a flexible strap operably coupled to the rest.

5. The new and improved shooting device of claim 1 wherein the adjustable leg means comprise multiple threadedly engaging cylindrical sections which may be assembled in various configurations for insertion into the leg base member means, yielding adjustments in overall shooting height and positioning of the device to suit requirements of the local terrain.

6. The new and improved shooting device of claim 5 wherein the adjustable leg means further comprise at least one ear tab positioned about the side surface wall.

7. The new and improved shooting device of claim 1 wherein the vertical support member comprises a first cylinder body section and a second cylinder body section operably positioned within the first cylinder body section, both cylinder bodies having a top end, a bottom end, and a wall surface integral with and extending between the top and bottom ends, the first cylinder body section having a lesser exterior diameter than the interior diameter of the vertical support member, the second cylinder body section having a lesser exterior diameter than the interior diameter of the fist cylinder body, thereby enabling a telescoping extension of cylinder body sections during use and a nesting capability within the vertical support member for compactness during storage.

8. The new and improved shooting device of claim 7 wherein the first cylinder body section further includes a rotatable knurled threaded ring positioned about the top end of the first cylinder body section for securing and rendering immovable the second section relative the first section, wherein clockwise rotation of the ring secures the first and second cylinder sections at the desired height, and counterclockwise rotation of the ring unsecures the first and second sections, thus enabling a user to make adjustments of the overall height of the device.

9. The new and improved shooting device of claim 7 further including a rotatable knob and threaded shaft positioned within an aperture extending through the wall of the main cylinder body for securing the first section at a desired height within the vertical support, wherein clockwise rotation of the knob and threaded shaft extends the shaft for contacting the first cylinder section for fixedly securing the first cylinder section within the vertical support member, wherein counterclockwise rotation of the knob and threaded shaft unsecures the first section relative to the vertical support member, thus enabling a user to make additional adjustments of the overall height of the device.

10. A new and improved assembly including a shooting device comprising a hollow cylindrical vertical support member having a top end, a bottom end, and a wall surface integral with and extending between the top and bottom ends for supporting a rifle from underneath;

a two-piece rotatable cap and ball tilt mechanism means for enabling adjustment of declination and inclination of a rifle supported in a gun rest operable coupled at the top end of the vertical support member;

a U-shaped gun rest means for supporting a rifle operably coupled at the top end of a two-piece rotatable and ball tilt mechanism means;

a conical truncated leg base member having a larger diameter top end, a smaller diameter bottom end, and a wall surface integral with, and extending between, the to and bottom ends, having a narrowed threaded portion at the top end for threadably engaging the vertical support member and threaded apertures extending from the exterior wall surface inwardly;

at least one adjustable leg means threadedly engaging and extending from the leg base member for placing on the ground, thus enabling a method of stabilizing the device, the leg means comprising a plurality of rods having a threaded portion extending from first end and a threaded recess integral with a second end for coupling a number of rods to form legs of varying length, the bottom leg portion having a non-slip cap for positioning on the ground, allowing the present invention to be used with up to four legs as a quadruped, or with one, two, or three legs, as a monopod, bipod, or tripod, respectively;

and further including a fabric rucksack for conveyance and storage of the shooting device in a first portion, wherein the first portion includes at least one storage channel positioned centrally, said channel having a top and bottom end, extending from the top surface of the rucksack to the bottom surface, the storage channel being closed on the bottom and having an upwardly opening flap positioned about the top end for receiving the shooting device for conveyance and storage and shielding the same from dirt and the elements, and further having additional storage channels on either side of the central storage channel for carrying supplies and miscellaneous accouterments, said additional storage channels having supplemental pockets for carrying articles positioned at a bottom portion of each additional storage channel on the external face thereof.

11. The new and improved assembly of claim 10 wherein the rucksack further includes a second pack portion opposite the first portion, said first and second portions connected by a first strap at the top ends thereof, and a second strap at the bottom end of each portion, said second straps each having a free end for coupling to each other via hook and loop fasteners, wherein the first and second straps are to be fastened one above and one below either shoulder of the user, enabling the rucksack to be slung securely over one shoulder during conveyance due to the position of the straps.

* * * * *